US006376092B1

(12) United States Patent
Ishizuka et al.

(10) Patent No.: US 6,376,092 B1
(45) Date of Patent: Apr. 23, 2002

(54) SURFACE-TREATED STEEL SHEET AND MANUFACTURING METHOD THEREOF

(75) Inventors: Kiyokazu Ishizuka; Hidetoshi Shindo; Kimitaka Hayashi; Daisuke Ito, all of Himeji (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/673,890

(22) PCT Filed: Apr. 16, 1999

(86) PCT No.: PCT/JP99/02027

§ 371 Date: Oct. 23, 2000

§ 102(e) Date: Oct. 23, 2000

(87) PCT Pub. No.: WO99/54523

PCT Pub. Date: Oct. 28, 1999

(30) Foreign Application Priority Data

Apr. 23, 1998 (JP) ..... 10-113365
Mar. 3, 1999 (JP) ..... 11-055156

(51) Int. Cl.[7] ..... B32B 15/04; C23C 22/07

(52) U.S. Cl. ..... 428/472.3; 148/250; 148/254; 148/255; 148/261; 148/262; 148/263; 148/273; 428/472.2; 428/659; 428/681; 428/471; 428/684; 428/628

(58) Field of Search ..... 428/659, 681, 428/471, 684, 472.3, 472.2, 628; 148/250, 254, 255, 261, 262, 263, 273

(56) References Cited

U.S. PATENT DOCUMENTS 3,723,334 A * 3/1973 Maurer ..... 106/14.05
4,505,760 A * 3/1985 Itoh et al. ..... 148/242
4,722,753 A 2/1988 Zurilla et al.
5,207,840 A 5/1993 Riesop et al.
5,525,431 A * 6/1996 Kanamaru et al. ..... 148/258
5,597,465 A * 1/1997 Pedrazzini ..... 148/259

FOREIGN PATENT DOCUMENTS

EP 0653502 5/1995
WO 85/03089 7/1985

* cited by examiner

*Primary Examiner*—Deborah Jones
*Assistant Examiner*—Enrique F. Osorio
(74) *Attorney, Agent, or Firm*—Wenderoth, Lind & Ponack, L.L.P.

(57) ABSTRACT

The present invention has an object to provide a surface-treated steel sheet which has highly balanced corrosion resistance and formability, and satisfies fundamental properties required mainly for steel sheets for automobile body, and a manufacturing method thereof. The surface-treated steel sheet of the invention is excellent in corrosion resistance and formability, comprising an amorphous inorganic film containing at least 5% magnesium and having a weight within a range of from 0.1 to 2.0 g/m$^2$, formed on the surface of a zinc or zinc alloy plated steel sheet; wherein the inorganic film is soluble in an acidic solution and hardly soluble in a neutral or alkaline solution, and a manufacturing method thereof is provided. A zinc phosphate film may be provided between the galvanized steel sheet and the amorphous inorganic film. The inorganic film should preferably comprise one or more selected from the group consisting of phosphoric acid, phosphates, biphosphates, various condensed phosphoric acids, various condensed phosphates, organic phosphoric acid, and organic phosphates.

7 Claims, No Drawings

SURFACE-TREATED STEEL SHEET AND MANUFACTURING METHOD THEREOF

TECHNICAL FIELD

The present invention relates to a surface-treated steel sheet excellent in corrosion resistance and formability applicable mainly for automobile body uses.

BACKGROUND ART

There is at present an increasing demand for improvement of both corrosion resistance and formability of steel sheets for automobile body uses. Particularly as to corrosion resistance, a problem is that pitting corrosion is produced in a joint portion between steel sheets known as a hem flange. Since painting, if any, does not cause the paint to adhere to the hem flange, a steel sheet is demanded to be corrosion-resistant for this portion in a non-painted state. For the purpose of improving corrosion resistance of steel sheet to satisfy this demand, a steel sheet manufactured by plating the steel sheet with a Zn—Ni alloy of a thin coating weight of 20 to 30 g/m$^2$, and further forming a chromate film and an organic film on the alloy film is now widely in use. While such a steel sheet has sufficient performance in corrosion resistance as well as in formability, the presence of an upper organic film acting as an insulating layer poses problems of easy occurrence of poor appearance upon ED-painting and difficulty to obtain a uniform appearance of painting. In addition, use of expensive nickel and containing detrimental hexavalent chromium are another problems. While a galvanized steel sheet having an increased coating weight or a Zn—Fe alloy coated steel sheet is also used, an increase in coating weight of plating generally results in an improved corrosion resistance but in a poorer formability. It is therefore very difficult to satisfy requirements for both corrosion resistance and formability.

Japanese Examined Patent Publication No. 3-28509 discloses a highly corrosion-resistant plated steel sheet having a magnesium plating layer formed on a galvanizing layer, and Japanese Unexamined Patent Publication No. 2-254178 discloses a highly corrosion-resistant plated steel sheet having a composite film, comprising a metal magnesium and an oxide thereof, formed on a galvanizing layer. These steel sheets, having a high corrosion resistance, permit reduction of the coating weight, and an improvement to some extent is observed in formability, but has not as yet a performance sufficient to satisfy the general requirements.

(WO85/103089 and U.S. Pat. No. 4,722,753 describe corrosion-resistant coated metal objects and methods for producing the same by phosphate conversion coating, wherein said phosphate conversion coating is an improved zinc phosphate conversion coating method. The phosphating solution comprises first and second divalent cations, first metal cations selected from magnesium and transition metals having a hydroxide with lower solubility in alkaline solution than zinc hydroxide and zinc cations.)

DISCLOSURE OF INVENTION

The present invention has therefore an object to provide a coated steel sheet which solves the aforementioned drawbacks, satisfies requirements for both corrosion resistance and formability, and satisfies other basic properties required for a steel sheet mainly for automobile body uses, and a manufacturing method thereon.

In summary, the present invention provides:

(1) A surface-treated steel sheet comprising an amorphous inorganic film containing at least 5% magnesium and having a weight within a range of from 0.1 to 2.0 g/m$^2$, formed on the surface of a zinc or zinc alloy plated steel sheet; wherein the inorganic film is soluble in an acidic solution and hardly soluble in a neutral or alkaline solution.

(2) A surface-treated steel sheet comprising a phosphate film formed on the surface of a zinc or zinc alloy plated steel sheet, and an amorphous inorganic film containing at least 5% magnesium and having a weight of at least 0.1 g/m$^2$ formed on the phosphate film; wherein the inorganic film is soluble in an acidic solution and hardly soluble in a neutral or alkaline solution, and the inorganic film and the phosphate film have a total film weight of up to 2.0 g/m$^2$.

(3) A surface-treated steel sheet according to item (2) above, wherein the phosphate film is a zinc phosphate film modified with one or more selected from the group consisting of nickel, magnesium, manganese, calcium, cobalt and copper.

(4) A surface-treated steel sheet according to item (3) above, wherein the amorphous inorganic film and the phosphate film have a total film weight within a range of from over 2.0 g/m$^2$ to 3.0 g/m$^2$.

(5) A surface-treated steel sheet according to any one of items (1) to (4) above, wherein the inorgarnic film comprises one or more selected from the group consisting of phosphoric acid, phosphates, biphosphates, condensed phosphoric acids, condensed phosphates, organic phosphoric acids, and organic phosphates.

(6) A surface-treated steel sheet according to any one of items (1) to (5) above, wherein a solution is coated onto the surface of the steel sheet having a clean surface; the steel sheet is a zinc or zinc alloy plated steel sheet or a zinc or zinc alloy plated steel sheet coated with a phosphate film; the aqueous solution contains magnesium dihydrogenphosphate as an essential component in a magnesium concentration in nonvolatile matters of at least 5%; and the steel sheet is baked at a temperature within a range of from 90 to 150° C., and air-cooled.

BEST MODE FOR CARRYING OUT THE INVENTION

The surface-treated steel sheet of the present invention comprises an amorphous inorganic film containing magnesium as an upper layer on a galvanized steel sheet, wherein this film is hardly soluble in a neutral or alkaline solution and soluble in an acidic solution.

Magnesium contained in the inorganic film has a function of stabilizing corrosion products of zinc, thereby inhibiting progress of rust, and is therefore primarily necessary for improving corrosion resistance.

The morphology of magnesium compound in the inorganic film also has an effect on corrosion resistance. Morphology of magnesium compound in a metallic form, while being favorable for corrosion resistance, poses a problem in formability as described later, and further, causes very difficult problems in manufacturing technology as well as in manufacturing cost. A film mainly comprising crystalline magnesium cannot give a sufficiently satisfactory corrosion resistance because of a high porosity. For these reasons, the most preferable morphology of magnesium is in an amorphous form which permits formation of a tight layer. Whether amorphous or not can be determined through observation of crystal by surface SEM and presence of diffraction patterns in an X-ray diffraction.

In order to improve formability, the inorganic film of the invention must be an amorphous film. A film comprising metallic magnesium, magnesium oxide or magnesium phosphate has not effect of improving formability. Particularly when the coating weight is increased, the resultant steel sheet cannot withstand high-speed pressing for automobile. The amorphous inorganic film covers the soft galvanizing layer to serve as a hard barrier film, thereby inhibiting flaking of the galvanizing layer. The film itself has an excellent lubricating effect. Further, even upon generation of heat from the steel sheet subjected to press forming, the film does not lose this excellent effect, thus giving a very good formability.

The amorphous inorganic film containing magnesium, serving as a barrier film against corrosive factors, is favorable for improving corrosion resistance. However, when the film acts as a barrier against reactions in the chemical conversion treatment (phosphate treatment) carried out in automotive coating, the chemical conversion film does not adhere, thus causing problems in coating appearance and paint adhesion. The inorganic film of the invention must necessarily be solved in a weak acidic solution environment of such a chemical conversion solution (usually having a pH within a range of from 2 to 3), and this is the very point of the invention. Being soluble in an acidic solution means that application of the aforementioned chemical conversion treatment does not cause an abnormality such as a phosphate coating defect. A part of magnesium dissolved in the chemical conversion solution is trapped in the resultant chemical conversion film, thus facilitating formation of a dense and corrosion-resistant magnesium-containing chemical conversion film. It is needless to mention that, even after the chemical conversion treatment, another part of magnesium remains insoluble and contributes to improvement of corrosion resistance.

On the other hand, the portion of an automobile body requiring the highest corrosion resistance is the joint portion of steel sheets known as a hem flange. The chemical conversion treatment solution cannot sufficiently penetrate into this portion. As a result, a high corrosion resistance cannot be ensured through the chemical conversion film alone. In contrast, the inorganic film of the invention remains substantially completely without being dissolved, and permits achievement of a high corrosion resistance.

The inorganic film of the invention must be soluble in an acidic solution, as described above. In order to achieve a high corrosion resistance at the hem flange, on the other hand, the inorganic film of the invention must be hardly soluble in a neutral or alkaline solution. The inorganic film, if soluble in a neutral or alkaline solution, would be poor in dew-point corrosion resistance during storage, and easily dissolved in an alkaline degreasing solution on an automobile coating line, thus failing to have a corrosion resistance improving effect. A low solubility in a neutral or alkaline solution means that the film remains even through an alkaline degreasing process as described above.

It is more preferable to apply a zinc phosphate chemical conversion treatment with zinc phosphate or modified zinc phosphate to the galvanizing layer to form thereon an amorphous inorganic film of the invention. The amorphous inorganic film is held in zinc phosphate intercrystalline gaps, thus further improving resistance to an neutral or alkaline solution while maintaining phosphatability on the automobile coating line.

The term "being amorphous" as used in a case where a zinc phosphate chemical conversion treatment is applied onto a galvanizing layer to form thereon an amorphous inorganic film shall mean that there is observed no crystals caused by the inorganic film (for example, a magnesium biphosphate film) via a surface SEM observation and diffraction pattern observation in an X-ray diffraction, and only crystals of the steel sheet substrate, and/or crystals of the galvanizing layer, and/or crystals resulting from the zinc phosphate chemical conversion treatment are observed. The amorphous state can be determined via such means.

It is not desirable that the amorphous inorganic film of the invention contains compounds which may impair phosphatability such as chromium compounds or aluminum compounds. The amorphous inorganic film should preferably comprise phosphoric acid, a phosphate, a biphosphate, a condensed phosphoric acid, a condensed phosphate, organic phosphoric acid or an organic phosphate, containing magnesium, but the components are not limited to those enumerated above. A film comprising silica sol or a silicate is not desirable because it is poor in solubillty in a weak acidic solution and impairs paintability.

The magnesium content in the amorphous inorganic film of the invention must be at least 5%. A magnesium content of under 5% is not desirable in terms of corrosion resistance. A phosphoric acid amorphous inorganic film has usually a magnesium content of about 10%, but this is not limitative. A magnesium content of 100% corresponds to metallic magnesium, and is not of course desirable as described above.

The coating weight of the amorphous inorganic film of the invention must be within a range of from 0.1 to 2.0 $g/m^2$. A coating weight of under 0.1 $g/m^2$ gives no improving effect of corrosion resistance and formability. A coating weight of over 2.0 $g/m^2$ results in poorer formability and weldability. In a more preferred embodiment of the present invention, in which the amorphous inorganic film is formed, via a phosphate film, on the galvanizing layer, the upper limit of the film weight must be up to 2.0 $g/m^2$ in total of the phosphate film and the amorphous inorganic film. A film weight of over this level leads o poorer formability and weldability.

In a further more preferred embodiment of the invention, an amorphous inorganic film which is soluble in an acidic solution, hardly soluble in a neutral or alkaline solution and contains at least 5% magnesium is formed via a phosphate film modified with one or more selected from the group consisting of nickel, magnesium, manganese, calcium, cobalt and copper. This further improves corrosion resistance, and even an increased coating weight leads to a smaller extent of deterioration of formability and weldabillity. That is, the film weight in this case is limited to an upper limit of a total of 3.0 $g/m^2$ of the undercoat modified zinc phosphate film and the amorphous inorganic film. Sufficient weldability and formability can be ensured so far as this upper limit is not exceeded. The term the zinc phosphate film modified with nickel, magnesium, manganese, calcium, cobalt and/or copper as used herein shall mean a chemical conversion film formed with a zinc phosphate treatment solution in which ions of nickel, magnesium, manganese, calcium, cobalt and/or copper are co-existent. Only a very slight part of zinc in the zinc phosphate crystals (hopeite: $Zn_3(PO_4)_2 4H_2O$) is considered to be replaced by other metals, whereas diffraction patterns available from X-ray diffraction thereof cannot be discriminated from those of hopeite. Nickel, magnesium, manganese, calcium, cobalt and/or copper accounts for several % in total weight in the zinc phosphate film.

The aforementioned amorphous inorganic film which is hardly soluble in a neutral or alkaline solution, soluble in an acidic solution and contains magnesium may be prepared by a simple method at a low cost. There is available, for example, a method of coating an acidic solution containing magnesium biphosphate (magnesium dihydrogenphosphate, also known as primary magnesium phosphate) and baking the same. Coating may be carried out by any of the means commonly used such as spraying, dipping and use of a roll coater, and the coating method is not limited to a particular one.

There is no particular limitation imposed on the concentration of magnesium dihydrogenphosphate in the solution to be coated. Magnesium biphosphate (magnesium dihydrogenphosphate) solution commercially available at present has a concentration of 50% a method of using such a solution by appropriately diluting so as to achieve a prescribed coating weight is preferable. Magnesium should have a concentration of at least 5% in nonvolatile matters in the solution. With a lower magnesium concentration, it is impossible to obtain a magnesium concentration in the formed film of at least a prescribed value, leading to an insufficient corrosion resistance.

The solution contains magnesium biphosphate (magnesium dihydrogenphosphate) as an essential component, and phosphoric acid, condensed phosphoric acid, organic phosphoric acid or any of various phosphates should preferably be added. This addition makes it possible to control physical properties such as viscosity of the solution to values suitable for coating conditions. Even when adding these additives, it is necessary to adjust the magnesium content in nonvolatile matters in the solution to a value of at least 5%.

The other phosphates containing magnesium (for example, $MgHPO_4$ or $Mg_3(PO_4)_2$) are very hardly soluble in water, it is difficult to coat a solution of these salts. It is however possible to dissolved the same in a slight amount by adding an acid such as phosphoric acid in excess. In this case, however, the magnesium concentration in the resultant film is far lower than 5%, and an improving effect of corrosion resistance is unavailable. When coating an aqueous suspension prepared by dispersion-adjusting these low-solubility salts by the use of a dispersant such as starch or dextrin, the film is in crystalline state with a poor adhesion to the substrate.

Conditions for baking the steel sheet after coating the acidic solution containing magnesium biphosphate (magnesium dihydrogenphosphate) onto the steel sheet are also very important. It is essential to bake the steel sheet so as to achieve a temperature within a range of from 90 to 150° C. immediately after coating with the solution. At a temperature of under 90° C., the resultant film would have a poorer water-proof property. A temperature of over 150° C. impairs, on the other hand, solubility in a weak acidic solution. Baking should be carried out immediately after coating. If not, there occur reactions between acidic components in the solution and zinc and the like on the galvanizing surface, and this causes growth of a brittle crystalline film.

After baking, the baked steel sheet must be air-cooled (including spontaneous cooling by holding). For example, water spraying causes partial dissolution of the film, tending to result in a poor appearance. The surface before treatment should be clean. Coating on a surface containing stain makes it impossible to obtain a normal film.

When forming a phosphate film on the surface of the galvanized steel sheet, and further forming thereon an inorganic film of the invention, it suffices first to apply a zinc phosphate chemical conversion treatment to the galvanized steel sheet by a known method and coat the inorganic film by the method as described above. Prior to the zinc phosphate chemical conversion treatment, there may be carried out a surface adjustment (treatment with titanium colloid, and/or a treatment with an acid solution, and/or surface activation through brush polishing) by any of known methods.

Examples of the present invention will now be presented.

EXAMPLE 1

Manufacturing Method of Samples

The inorganic film of the invention was coated onto an alloyed hot-dip galvanized steel sheet (thickness: 0.7 mm; coating weight: 45 g/m$^2$ per side). After alkali spray-degreasing the steel sheet, the following treatment solutions were coated with a roll coater, and immediately after coating, the steel sheet was heated in a hot blast drying furnace to reach a prescribed sheet temperature, and then left to cool. The treatment solutions included an $Mg(H_2PO_4)$ reagent dissolved in water, and a magnesium biphosphate 50% solution (made by Yoneyama Kagaku Co.) water-diluted so as to achieve a prescribed coating weight. In Comparative Examples, solutions prepared by dissolving MgO, $MgHPO_4$, or $Mg_3(PO_4)_2$ in phosphoric acid, or a water suspension prepared by dispersion-suspended with a dispersant were employed. A sample prepared by plating magnesium metal as an upper layer by vapor deposition was also used.

The film weight was measured by the weight measurement method. The magnesium content in the film was determined by dissolving the film with an acid, determining the quantity of magnesium through ICP analysis, and calculating the content from the ratio to the film weight. The crystal state of whether crystalline or amorphous was determined through observation of the presence of crystals other than galvanizing crystals through surface SEM and determination of the presence of diffraction patterns other than those of the steel sheet and the galvanizing layer through X-ray diffraction.

Evaluation

Corrosion Resistance

After application of bead forming to the sample, an alkali degreasing solution (pH: 12.5) was sprayed, and the number of days before occurrence of 5% red rust was measured by the JIS-Z-2371 salt spray test (X: within two days; Δ: two to five days; ○: five to ten days; ⊙: ten days or over).

Formability

A rust preventive oil NOXRUST530f60 (made by Parker Trading Co.) was coated on the sample to carry out a limiting drawing test. The pressing conditions included BHF:1 ton and punch diameter of 40 mm (X: LDR value to 2.0; Δ: 2.0 to 2.2; ○: 2.2 to 2.3; ⊙: 2.3 or over).

Phosphatability

The sample was subjected to a treatment by the use of a chemical conversion treatment solution made by Nihon Paint Co. (SD2500), and the resultant sample appearance was visually observed (X: coating defects over the entire surface; Δ: coating defects partially observed; ○: substantially uniform appearance; ⊙: uniform appearance).

Water-proof Property

An alkali degreasing solution (pH: 12.5) was sprayed onto the sample, and the coating weight was measured before and after spraying to calculate the effluent rate which represented an evaluation of water-proof property (X: effluent rate of 100%; Δ: 41 to 99%; ○: 11 to 40%; ⊙: 10% or under).

Weldability appropriate range of current was measured with a Cu—Cr CF-type electrode chip under conditions including a pressing force of 200 kgf and 13 energizing cycles (X: 0: to 0.3 kA; Δ: 0.3 to 1.0 kA; ○: 1.0 to 1.5 kA; ⊙: 1.5 kA or over).

The results are shown in Table 1. In this Example, all the samples of the invention were excellent in corrosion resistance, formability and other properties, whereas those outside the ranges of conditions set forth in the invention showed deterioration in any of the properties.

TABLE 1

| | | TREATMENT CONDITION | | FILM CONDITION | | |
|---|---|---|---|---|---|---|
| No. | | TREATMENT SOLUTION | DRYING TEMP. | FILM WEIGHT | Mg CONTENT | CRYSTAL CONDITION |
| EXAMPLE OF THE INVENTION | 1 | $Mg(H_2PO_4)_2$ | 100° C. | 1.0 g/m$^2$ | 11% | AMORPHOUS |
| | 2 | $Mg(H_2PO_4)_2$ | 90° C. | 1.0 g/m$^2$ | 11% | AMORPHOUS |
| | 3 | $Mg(H_2PO_4)_2$ | 150° C. | 1.0 g/m$^2$ | 11% | AMORPHOUS |
| | 4 | $Mg(H_2PO_4)_2$ + PHOSPHORIC ACID | 100° C. | 1.0 g/m$^2$ | 5% | AMORPHOUS |
| | 5 | Mg BIPHOSPHATE SOLUTION | 100° C. | 0.1 g/m$^2$ | 10% | AMORPHOUS |
| | 6 | Mg BIPHOSPHATE SOLUTION | 100° C. | 0.5 g/m$^2$ | 10% | AMORPHOUS |
| | 7 | Mg BIPHOSPHATE SOLUTION | 100° C. | 0.7 g/m$^2$ | 10% | AMORPHOUS |
| | 8 | Mg BIPHOSPHATE SOLUTION | 100° C. | 1.0 g/m$^2$ | 10% | AMORPHOUS |
| | 9 | Mg BIPHOSPHATE SOLUTION | 100° C. | 1.5 g/m$^2$ | 10% | AMORPHOUS |
| | 10 | Mg BIPHOSPHATE SOLUTTON | 100° C. | 2.0 g/m$^2$ | 10% | AMORPHOUS |
| COMPARATIVE EXAMPLE | 11 | NONE | — | — | — | — |
| | 12 | Mg BIPHOSPHATE SOLUTION | 100° C. | 0.05 g/m$^2$ | 10% | AMORPHOUS |
| | 13 | Mg BIPHOSPHATE SOLUTION | 100° C. | 2.5 g/m$^2$ | 10% | AMORPHOUS |
| | 14 | MgO + DISPERSANT | 100° C. | 1.0 g/m$^2$ | 50% | CRYSTALLINE |
| | 15 | $MgHPO_4$ + DISPERSANT | 100° C. | 1.0 g/m$^2$ | 20% | CRYSTALLINE |
| | 16 | $Mg_3(PO_4)_2$ + DISPERSANT | 100° C. | 1.0 g/m$^2$ | 27% | CRYSTALLINE |
| | 17 | $MgHPO_4$ + PHOSPHORIC ACID | 100° C. | 1.0 g/m$^2$ | 3% | AMORPHOUS |
| | 18 | $Mg(H_2PO_4)_2$ + COLLOIDAL SILICA | 100° C. | 1.0 g/m$^2$ | 5% | AMORPHOUS |
| | 19 | Mg BIPHOSPHATE SOLUTION | 60° C. | 1.0 g/m$^2$ | 10% | AMORPHOUS |
| | 20 | Mg BIPHOSPHATE SOLUTION | 180° C. | 1.0 g/m$^2$ | 10% | AMORPHOUS |
| | 21 | (Mg METAL VAPOR DEPOSITION) | | 1.0 g/m$^2$ | 100% | CRYSTALLINE |

| | | RESULT OF PERFORMANCE EVALUATION | | | | |
|---|---|---|---|---|---|---|
| No. | | CORROSION RESISTANCE | FORM-ABILITY | PHOSPHAT-ABILITY | WATER PROOF PROPERTY | WELD-ABILITY |
| EXAMPLE OF THE INVENTION | 1 | ⊙ | ⊙ | ⊙ | ⊙ | ⊙ |
| | 2 | ⊙ | ⊙ | ⊙ | ⊙ | ⊙ |
| | 3 | ⊙ | ⊙ | ⊙ | ⊙ | ⊙ |
| | 4 | ⊙ | ⊙ | ⊙ | ⊙ | ⊙ |
| | 5 | ○ | ⊙ | ⊙ | ⊙ | ○ |
| | 6 | ⊙ | ⊙ | ⊙ | ⊙ | ⊙ |
| | 7 | ⊙ | ⊙ | ⊙ | ⊙ | ⊙ |
| | 8 | ⊙ | ⊙ | ⊙ | ⊙ | ⊙ |
| | 9 | ⊙ | ⊙ | ⊙ | ⊙ | ⊙ |
| | 10 | ⊙ | ○ | ⊙ | ⊙ | ○ |
| COMPARATIVE EXAMPLE | 11 | x | x | ⊙ | ⊙ | x |
| | 12 | x | Δ | ⊙ | ⊙ | x |
| | 13 | ⊙ | ○ | ⊙ | ⊙ | x |
| | 14 | Δ | x | ⊙ | x | x |
| | 15 | Δ | x | ⊙ | x | x |
| | 16 | Δ | x | ⊙ | x | x |
| | 17 | Δ | ⊙ | ⊙ | ○ | ⊙ |
| | 18 | Δ | ⊙ | x | ⊙ | ○ |
| | 19 | Δ | ⊙ | ⊙ | x | ⊙ |
| | 20 | ⊙ | ⊙ | x | ⊙ | ⊙ |
| | 21 | ⊙ | x | ⊙ | ⊙ | x |

EXAMPLE 2

Manufacturing Method of Samples

The present invention was applied to an electrogalvanized steel sheet (thickness: 0.7 mm; coating weight: 30 g/m$^2$ per side). After alkali spray degreasing of the steel sheet, a zinc phosphate treatment (Bt3307 made by Nihon Parker Co.) was applied. The zinc phosphate film weight was measured through fluorescent X-ray analysis. Observation of crystal grains of the zinc phosphate film revealed a grain size of from 8 to 20 $\mu$m. Further, the following treatment solution was coated with a roll coater, and the coated steel sheet was heated in a hot blast drying furnace to a prescribed sheet temperature. The heated steel sheet was then left to cool. From among the treatment solutions used in Example 1, magnesium biphosphate solution was employed.

The upper layer weight was measured by the weight measurement method. The state of crystals in the upper layer as to whether crystalline or amorphous was determined through observation of crystals other than the galvanizing crystal and zinc phosphate crystal by surface SEM and determination of the presence of diffraction patterns other than those for the steel sheet, the zinc plating layer and zinc phosphate by X-ray diffraction patterns (water contained in the magnesium biphosphate solution was evaporated in a beaker, and patterns are observed by measuring the resultant powder). This method permitted determination of the samples of both Examples and Comparative Examples shown in Table 2 to be amorphous films.

Evaluation

Evaluation was conducted in the same manner as in Example 1, and evaluation of "water-proof adhesion" was added. The method of evaluation is as follows.

Water-proof Adhesion:

The sample used in the evaluation of "phosphatability" was further subjected to automobile cation electrodeposition (V-20 made by Nihon Paint Co.) Further, the sample was coated with an automobile intermediate paint (OTO-H870 made by Nihon Paint Co.) and an automobile surface paint (OTO-650PZ made by Nihon Paint Co.), and immersed in hot water of 50° C. for ten days. Flaws were cut in 1-mm checkers and an adhesion tape peeling test was carried out. Water-proof adhesion was evaluated from the peeling area ratio (X: 100 to 50: %; Δ: 51 to 5%; ○: 4% or under; ⊙: 0%).

The results are shown in Table 2. The samples of the invention were excellent both in corrosion resistance and in formability, whereas, for the samples outside the conditions set forth in the invention, any of the properties deteriorated.

TABLE 2

| | | WEIGHT OF ZINC PHOSPHATE FILM | TREATMENT CONDITION | | | TOTAL FILM WEIGHT |
|---|---|---|---|---|---|---|
| | | | TREATMENT SOLUTION | DRYING TEMP. | FILM WEIGHT | |
| EXAMPLE OF THE INVENTION | 22 | 0.2 g/m$^2$ | Mg BIPHOSPHATE SOLUTION | 100° C. | 1.0 g/m$^2$ | 1.1 g/m$^2$ |
| | 23 | 0.5 g/m$^2$ | Mg BIPHOSPHATE SOLUTION | 100° C. | 1.0 g/m$^2$ | 1.5 g/m$^2$ |
| | 24 | 0.5 g/m$^2$ | Mg BIPHOSPHATE SOLUTION | 100° C. | 1.5 g/m$^2$ | 2.0 g/m$^2$ |
| | 25 | 1.0 g/m$^2$ | Mg BIPHOSPHATE SOLUTI ON | 100° C. | 0.1 g/m$^2$ | 1.1 g/m$^2$ |
| | 26 | 1.0 g/m$^2$ | Mg BIPHOSPHATE SOLUTION | 100° C. | 1.0 g/m$^2$ | 2.0 g/m$^2$ |
| | 27 | 1.5 g/m$^2$ | Mg BIPHOSPHATE SOLUTION | 100° C. | 0.1 g/m$^2$ | 1.6 g/m$^2$ |
| | 28 | 1.5 g/m$^2$ | Mg BIPHOSPHATE SOLUTION | 100° C. | 0.5 g/m$^2$ | 2.0 g/m$^2$ |
| COMPARATIVE EXAMPLE | 29 | 0.5 g/m$^2$ | Mg BIPHOSPHATE SOLUTION | 100° C. | 2.0 g/m$^2$ | 2.5 g/m$^2$ |
| | 30 | 1.0 g/m$^2$ | Mg BIPHOSPHATE SOLUTION | 100° C. | 1.5 g/m$^2$ | 2.5 g/m$^2$ |
| | 31 | 1.5 g/m$^2$ | Mg BIPHOSPHATE SOLUTION | 100° C. | 1.0 g/m$^2$ | 2.5 g/m$^2$ |
| | 32 | 2.0 g/m$^2$ | Mg BIPHOSPHATE SOLUTION | 100° C. | 0.1 g/m$^2$ | 2.1 g/m$^2$ |

TABLE 2-continued

| | | PERFORMANCE EVALUATION | | | | | |
|---|---|---|---|---|---|---|---|
| | | CORROSION RESISTANCE | FORM-ABILITY | PHOSPHAT-ABILITY | WATER-PROOF PROPERTY | WELD-ABILITY | WET ADHESION |
| EXAMPLE OF THE INVENTION | 22 | ◎ | ◎ | ◎ | ◎ | ◎ | ◎ |
| | 23 | ◎ | ◎ | ◎ | ◎ | ◎ | ○ |
| | 24 | ◎ | ◎ | ◎ | ◎ | ◎ | ○ |
| | 25 | ◎ | ◎ | ◎ | ◎ | ◎ | ○ |
| | 26 | ◎ | ◎ | ◎ | ◎ | ◎ | ○ |
| | 27 | ◎ | ◎ | ◎ | ◎ | ◎ | ○ |
| | 28 | ◎ | ◎ | ◎ | ◎ | ◎ | ○ |
| COMPARATIVE EXAMPLE | 29 | ◎ | Δ | ◎ | ◎ | x | ○ |
| | 30 | ◎ | Δ | ◎ | ◎ | x | ○ |
| | 31 | ◎ | Δ | ◎ | ◎ | x | ○ |
| | 32 | ○ | x | ◎ | ◎ | x | Δ |

EXAMPLE 3

Manufacturing Method of Sample

The same electrogalvanized steel sheet (thickness: 0.7 mm; coating weight: 30 g/m$^2$ per side) as in Example 2 was used. After alkali spray degreasing, a titanium colloid surface adjustment (PL-Zn made by Nihon Parker Co.) was applied, and then a zinc phosphate treatment (PB-3322 made by Nihon Parker Co.) was applied. The coating weight of the zinc phosphate film was measured by fluorescent X-ray analysis. Trace metal elements were measured through an ICP analysis by dissolving the zinc phosphate film in a chromic acid solution: the results included 3 to 5% nickel and 0.2 to 0.7% magnesium (in weight ratio to the zinc phosphate film). Observation of crystal grains of the zinc phosphate film through SEM revealed a grain size of from 1 to 9 $\mu$m. The same treatment solution as in Example 2 was further coated on the thus formed zinc phosphate film by means of a roll coater, and the coated steel sheet was heated to a prescribed sheet temperature in a hot blast drying furnace, and was then left to cool.

The upper layer weight was measured by the weight measurement method. The state of crystals in the upper layer as to whether crystalline or amorphous was determined through observation of crystals other than the galvanizing crystal and zinc phosphate crystal by surface SEM and determination of the presence of diffraction patterns other than those for the steel sheet, the plating layer and zinc phosphate by X-ray diffraction patterns (water contained in the magnesium biphosphate solution was evaporated in a beaker, and patterns are observed by measuring the resultant powder). This method permitted determination of the samples of both Examples and Comparative Examples shown in Table 3 to be amorphous films.

Evaluation

The results were evaluated in the same manner as in Example 2.

The results are shown in Table 3. While the samples of the invention were excellent in all the properties including corrosion resistance and formability, the samples outside the scope of conditions of the invention showed deterioration of any of the properties.

TABLE 3

| | | WEIGHT OF ZINC PHOSPHATE FILM | TREATMENT CONDITION | | | TOTAL FILM WEIGHT |
|---|---|---|---|---|---|---|
| | | | TREATMENT SOLUTION | DRYING TEMP. | FILM WEIGHT | |
| EXAMPLE OF THE INVENTION | 33 | 0.5 g/m$^2$ | Mg BIPHOSPHATE SOLUTION | 100° C. | 1.0 g/m$^2$ | 1.5 g/m$^2$ |
| | 34 | 1.0 g/m$^2$ | Mg BIPHOSPHATE SOLUTION | 100° C. | 1.0 g/m$^2$ | 2.0 g/m$^2$ |
| | 35 | 1.0 g/m$^2$ | Mg BIPHOSPHATE SOLUTION | 100° C. | 1.5 g/m$^2$ | 2.5 g/m$^2$ |
| | 36 | 1.5 g/m$^2$ | Mg BIPHOSPHATE SOLUTION | 100° C. | 0.1 g/m$^2$ | 1.6 g/m$^2$ |
| | 37 | 1.5 g/m$^2$ | Mg BIPHOSPHATE SOLUTION | 100° C. | 0.5 g/m$^2$ | 2.0 g/m$^2$ |

TABLE 3-continued

| | | | | | | |
|---|---|---|---|---|---|---|
| | 38 | 2.0 g/m$^2$ | Mg BIPHOSPHATE SOLUTION | 100° C. | 0.1 g/m$^2$ | 2.1 g/m$^2$ |
| | 39 | 2.5 g/m$^2$ | Mg BIPHOSPHATE SOLUTION | 100° C. | 0.5 g/m$^2$ | 3.0 g/m$^2$ |
| COMPARATIVE EKAMPLE | 40 | 0.5 g/m$^2$ | Mg BIPHOSPHATE SOLUTION | 100° C. | 3.0 g/m$^2$ | 3.5 g/m$^2$ |
| | 41 | 1.0 g/m$^2$ | Mg BIPHOSPHATE SOLUTION | 100° C. | 2.1 g/m$^2$ | 3.1 g/m$^2$ |
| | 42 | 2.5g/m$^2$ | Mg BIPHOSPHATE SOLUTION | 100° C. | 1.0 g/m$^2$ | 3.5 g/m$^2$ |
| | 43 | 3.0 g/m$^2$ | Mg BIPHOSPHATE SOLUTION | 100° C. | 0.1 g/m$^2$ | 3.1 g/m$^2$ |

| | | PERFORMANCE EVALUATION | | | | | |
|---|---|---|---|---|---|---|---|
| | | CORROSION RESISTANCE | FORM-ABILITY | PHOSPHAT-ABILITY | WATER-PROOF PROPERTY | WELD-ABILITY | WET ADHESION |
| EXAMPLE OF THE INVENTION | 33 | ◎ | ◎ | ◎ | ◎ | ◎ | ◎ |
| | 34 | ◎ | ◎ | ◎ | ◎ | ◎ | ◎ |
| | 35 | ◎ | ◎ | ◎ | ◎ | ◎ | ◎ |
| | 36 | ◎ | ◎ | ◎ | ◎ | ◎ | ◎ |
| | 37 | ◎ | ◎ | ◎ | ◎ | ◎ | ◎ |
| | 38 | ◎ | ◎ | ◎ | ◎ | ◎ | ◎ |
| | 39 | ◎ | ○ | ◎ | ◎ | ○ | ◎ |
| COMPARATIVE EXAMPLE | 40 | ◎ | Δ | ◎ | ◎ | x | ○ |
| | 41 | ◎ | Δ | ◎ | ◎ | Δ | ◎ |
| | 42 | ◎ | Δ | ◎ | ◎ | x | ◎ |
| | 43 | ○ | Δ | ◎ | ◎ | Δ | ◎ |

Industrial Applicability

According to the present invention, it is possible to obtain a galvanized steel sheet satisfying the requirements for both corrosion resistance and formability so far unavailable. The steel sheet of the invention is suitable as a steel. sheet for automobile in that it is excellent in properties such as weldability and paintability, not using detrimental matters such as hexavalent chromium, is manufacturable by a simple method and favorable in cost.

What is claimed is:

1. A surface-treated steel sheet comprising an amorphous inorganic film containing at least 5% magnesium and having a weight within a range of from 0.1 to 2.0 g/m$^2$, formed on the surface of a zinc or zinc alloy plated steel sheet by immediate baking after coating to avoid chemical reactions between acidic components in the solution and zinc; wherein said amorphous inorganic film is soluble in an aqueous acidic solution and hardly soluble in an aqueous neutral or alkaline solution.

2. A surface-treated steel sheet comprising a phosphate film formed on the surface of a zinc or zinc alloy plated steel sheet, and an amorphous inorganic film containing at least 5% magnesium and having a weight of at least 0.1 g/m$^2$ formed on said phosphate film; wherein said amorphous inorganic film is soluble in an acidic solution and hardly soluble in a neutral or alkaline solution, and said inorganic film and the phosphate film have a total film weight of up to 2.0 g/m$^2$.

3. A surface-treated steel sheet comprising a phosphate film formed on the surface of a zinc or zinc alloy plated steel sheet, and an amorphous inorganic film containing at least 5% magnesium and having a weight of at least 0.1 g/m$^2$ formed on said phosphate film; wherein said amorphous inorganic film is soluble in an acidic solution and hardly soluble in a neutral or alkaline solution, and said inorganic film and the phosphate film have a total film weight of up to 3.0 g/m$^2$, wherein said phosphate film is a zinc phosphate film modified with one or more selected from the group consisting of nickel, magnesium, manganese, calcium, cobalt and copper.

4. A surface-treated steel sheet according to claim 3, wherein said amorphous inorganic film and said phosphate film have a total film weight within a range of from over 2.0 g/m$^2$ to 3.0 g/m$^2$.

5. A surface-treated steel sheet according to any one of claims 1 to 4, wherein said amorphous inorganic film comprises one or more selected from the group consisting of phosphoric acid, phosphates, biphosphates, various condensed phosphoric acids, various condensed phosphates, organic phosphoric acid, and organic phosphates.

6. A process for producing a surface-treated steel sheet according to any one of claims 1 to 4 which comprises: a step of coating on a surface of a zinc or zinc alloy plated steel sheet or a zinc or zinc alloy plated steel sheet coated with a phosphate film, an aqueous solution containing magnesium dihydrogenphosphate as an essential component with a magnesium concentration of at least 5% in nonvolatile matters, and a step of baking the steel sheet coated with the aqueous solution immediately after the coating step at a temperature ranging from 90 to 150° C., followed by a step of cooling the baked steel sheet in the air.

7. A process for producing a surface-treated steel sheet according to claim 5 which comprises: a step of coating on a surface of a zinc or zinc alloy plated steel sheet or a zinc or zinc alloy plated steel sheet coated with a phosphate film, an aqueous solution containing magnesium dihydrogen-phosphate as an essential component with a magnesium concentration of at least 5% in nonvolatile matters, and a step of baking the steel sheet coated with the aqueous solution immediately after the coating step at a temperature ranging from 90 to 150° C., followed by a step of cooling the baked steel sheet in the air.

* * * * *